US009682850B2

(12) United States Patent
Perrier

(10) Patent No.: US 9,682,850 B2
(45) Date of Patent: Jun. 20, 2017

(54) CONTAINER FILLING MACHINE AND METHOD

(71) Applicant: PEP TECHNOLOGIES, Le Cheylard (FR)

(72) Inventor: Philippe Perrier, Le Cheylard (FR)

(73) Assignee: PEP TECHNOLOGIES, Le Cheylard (FR)

( * ) Notice: Subject to any disclaimer, the term of this patent is extended or adjusted under 35 U.S.C. 154(b) by 173 days.

(21) Appl. No.: 14/420,955

(22) PCT Filed: Aug. 13, 2013

(86) PCT No.: PCT/FR2013/051936

§ 371 (c)(1),
(2) Date: Feb. 11, 2015

(87) PCT Pub. No.: WO2014/029938

PCT Pub. Date: Feb. 27, 2014

(65) Prior Publication Data

US 2015/0191339 A1 Jul. 9, 2015

(30) Foreign Application Priority Data

Aug. 24, 2012 (FR) ..... 12 57984

(51) Int. Cl.

| | |
|---|---|
| ***B65B 31/00*** | (2006.01) |
| ***B67C 3/26*** | (2006.01) |
| ***B67C 3/06*** | (2006.01) |

(52) U.S. Cl.

CPC ..... *B67C 3/262* (2013.01); *B67C 3/06* (2013.01)

(58) Field of Classification Search

CPC .. B67C 3/262; B67C 3/06; B67C 3/08; B67C 3/10; B67C 3/12; B67C 3/26; B67C 3/2614; B67C 3/2617

See application file for complete search history.

(56) References Cited

U.S. PATENT DOCUMENTS 1,915,066 A * 6/1933 Meyer ..... B67C 3/06 141/147
1,926,290 A * 9/1933 Krieglmeyer ..... B67C 3/06 141/305

(Continued)

FOREIGN PATENT DOCUMENTS

| | | |
|---|---|---|
| BE | 435 563 | 8/1939 |
| DE | 10 76 518 | 2/1960 |

(Continued)

*Primary Examiner* — Timothy L Maust
*Assistant Examiner* — Randall Gruby
(74) *Attorney, Agent, or Firm* — Clark & Brody

(57) ABSTRACT

A method of filling containers with the help of a filler liquid stored in a pressure regulated vessel and delivered using at least one filler head comprises a filler tube and provided with a main shutter, the filler tube including internally a discharge cannula. After engaging the filler tube inside the container, the main shutter of the tube is opened and a vent is created for the container and for the cannula, communication between the cannula and the vessel being closed. Before the end of filling, the vent is closed and the cannula is put into communication with the vessel. At the end of filling, when the liquid reaches a determined level of the tube, the shutter of the tube is closed, and communication between the discharge cannula and the vessel is closed.

7 Claims, 8 Drawing Sheets

(56) References Cited

U.S. PATENT DOCUMENTS 2,663,479 A * 12/1953 Detrez ..... B67C 3/06 141/149
2,813,555 A * 11/1957 Fox ..... B67C 3/225 141/305
3,381,723 A * 5/1968 Quest ..... B67C 3/08 141/39
3,385,327 A * 5/1968 Hector ..... B67C 3/06 141/302
3,519,035 A * 7/1970 Roger ..... G01F 11/32 141/287
3,633,635 A * 1/1972 Kaiser ..... B67C 3/06 137/392
4,270,585 A * 6/1981 Mette ..... B67C 3/12 141/302
4,307,762 A * 12/1981 Mette ..... B67C 3/262 141/284
4,363,339 A * 12/1982 Puskarz ..... B67C 3/08 141/303
4,386,635 A * 6/1983 Ahlers ..... B67C 3/287 137/392
4,989,650 A * 2/1991 Weiss ..... B67C 3/06 141/198
5,054,527 A * 10/1991 Rozier ..... B24B 53/001 141/147
5,145,008 A * 9/1992 Yun ..... B67C 3/06 141/147
5,156,200 A * 10/1992 Mette ..... B67C 3/26 141/287
5,445,194 A * 8/1995 Clusserath ..... B67C 3/10 141/146
5,501,253 A * 3/1996 Weiss ..... B67C 3/2614 141/198
5,564,481 A * 10/1996 Clusserath ..... B67C 3/10 141/39
6,192,946 B1 * 2/2001 Clusserath ..... B67C 3/12 141/40
6,601,618 B2 * 8/2003 Tsukano ..... B67C 3/10 141/290
6,817,386 B2 * 11/2004 Tsukano ..... B67C 3/281 141/146
8,381,777 B2 * 2/2013 Lupi ..... B67C 3/2617 141/144
8,776,839 B2 * 7/2014 Clusserath ..... B67C 3/10 141/302
9,108,836 B2 * 8/2015 Clusserath ..... B67C 3/2622
2002/0139434 A1 * 10/2002 Meheen ..... B67C 3/10 141/40
2002/0179177 A1 * 12/2002 Tsukano ..... B67C 3/10 141/57
2003/0106606 A1 * 6/2003 Stocchi ..... B67C 3/262 141/198
2003/0150517 A1 * 8/2003 Decarne ..... B67C 3/26 141/286
2005/0178466 A1 * 8/2005 Tanikawa ..... B67C 3/2614 141/57
2005/0198921 A1 * 9/2005 Clusserath ..... B67C 3/002 53/136.1
2005/0199314 A1 * 9/2005 Ruble ..... B65B 39/004 141/146
2007/0006939 A1 * 1/2007 Clusserath ..... B67C 3/2628 141/40
2009/0114310 A1 * 5/2009 Conforti ..... B67C 3/262 141/198
2010/0037983 A1 * 2/2010 Hiroya ..... B67C 3/2614 141/46
2010/0065150 A1 * 3/2010 Conforti ..... B67C 3/10 141/100
2011/0290374 A1 * 12/2011 Clusserath ..... B67C 3/06 141/67
2012/0037273 A1 * 2/2012 Graffin ..... B67C 3/262 141/290
2013/0092291 A1 * 4/2013 Fiegler ..... B67C 3/26 141/309
2014/0158253 A1 * 6/2014 Fogg ..... B67C 3/26 141/311 R
2016/0052765 A1 * 2/2016 Clusserath ..... B67C 3/007 141/6
2016/0115009 A1 * 4/2016 Clusserath ..... B67C 3/2617 141/65
2016/0145088 A1 * 5/2016 Krulitsch ..... B67C 3/26 141/39
2016/0152458 A1 * 6/2016 Clusserath ..... B67C 3/10 53/432
2016/0194188 A1 * 7/2016 Clusserath ..... B08B 9/283 141/7
2016/0214845 A1 * 7/2016 Clusserath ..... B67C 3/10

FOREIGN PATENT DOCUMENTS

DE 11 85 497 1/1965
DE 2361002 A1 * 6/1975 ..... B67C 3/08
DE EP 1544156 A1 * 6/2005 ..... B67C 3/06
EP 0 539 791 5/1993
FR 2 118 636 7/1972
FR 2 464 917 3/1981
FR 2 677 007 12/1992
FR 2677007 A1 * 12/1992 ..... B67C 3/04
JP WO 2007094049 A1 * 8/2007 ..... B67C 3/10

* cited by examiner

FIG.9
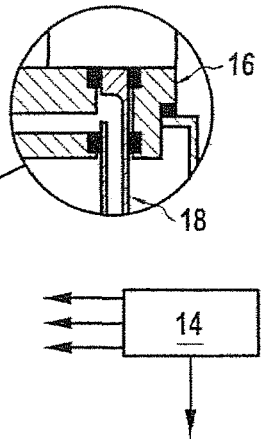
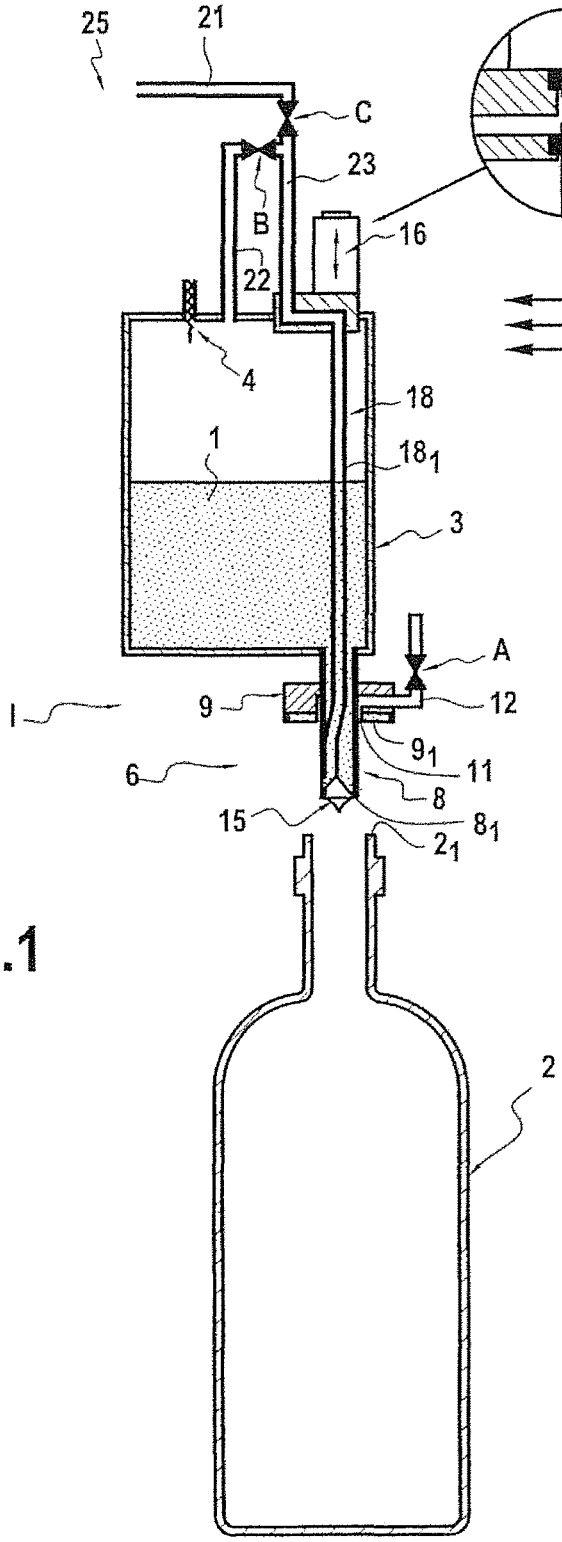
FIG.1

CONTAINER FILLING MACHINE AND METHOD

The invention relates to the general field of filling containers of any known type, such as containers made of glass or plastics material, and for filling them with a filler liquid of any kind.

In the prior art, numerous solutions are proposed for filling containers with a liquid and for setting the level of the liquid inside them.

For example, U.S. Pat. No. 1,978,002 describes filler machine having a vessel for storing a filler liquid. That storage vessel is connected to a filler head, and in general manner to a series of filler heads, with containers being brought in succession to the filler heads and then removed after filling. Each filler head comprises a filler tube passing through a bearing seat for bearing against the neck of the container. The tube serves to penetrate into the inside of the container and internally it includes a discharge cannula for recovering the air expelled from the inside of the container by the filler liquid. A vacuum is maintained inside the storage vessel in order to ensure that the liquid flows from the end of the filler tube. When the liquid reaches the bottom end of the filler tube, the liquid passes via the discharge cannula so as to be taken to the vessel or to a storage container. The level of liquid inside the container is determined by the bottom end of the filler tube.

It should firstly be understood that filling containers by using a vacuum can affect the quality of the filler liquid because the liquid becomes aerated. Furthermore, the quality of the liquid is also affected by the recirculation of the liquid that occurs in the presence of a container against the seat for receiving it, and even in the absence of such a container, but at a lower recirculation flow rate. Furthermore, it is found in practice that the operation of filling is relatively lengthy, in particular at the end of the filling operation, because bubbles or foam can be created, which make it difficult to set the level of the liquid.

Document DE 11 85 497 describes a technique of filling containers with a filler liquid stored in a pressure regulated vessel and delivered using at least one filler head having a filler tube passing through a bearing seat for bearing against the container and provided with a main shutter for allowing or interrupting the passage of filler liquid. Internally, the filler tube includes a discharge cannula and externally it cooperates with the bearing seat to define a communication passage communicating with a regulated vent circuit for venting from the container, which circuit has a shutter that is controlled to open and shut. The discharge cannula is connected by controlled shutters either to a regulated vent circuit for the cannula or to a communication circuit communicating with the vessel and enabling the container to be filled in gravity mode. The shutter of the filler tube is controlled by a controlled actuator.

Performing the technique described in that document leads to a filling operation that is relatively lengthy, in particular because of the creation of bubbles or foam at the end of the filling operation.

The present invention thus seeks to remedy the drawbacks of the prior art by proposing a novel filling technique that does not have recourse to a vacuum and that enables filling and level setting to be performed quickly, while presenting limited and controlled recirculation of the liquid that is independent from a container being brought into position.

To achieve such an object, the invention provides a method of filling containers with a filler liquid stored in a pressure regulated vessel and delivered via at least one filler head comprising a filler tube passing through a bearing seat for the container and provided with a main shutter to allow or interrupt the passage of filler liquid, the filler tube including internally a discharge cannula.

According to the invention, the method comprises the following steps for filling a container:

- after engaging the filler tube inside the container, opening the main shutter of the tube in order to fill the container with the liquid in regulated stream mode, and creating both a vent for the container and also a vent for the cannula, communication between the cannula and the vessel being closed;
- before the end of filling, closing the vents and putting the discharge cannula into communication with the vessel in order to fill the container with the liquid in gravity mode; and
- at the end of filling, when the liquid reaches a determined level of the filler tube, closing the shutter of the filler tube, closing communication between the discharge cannula and the vessel, and creating a vent for the inside of the container so as to allow the container to be removed from the filler head.

Furthermore, the method of the invention also includes in combination at least one and/or another of the following additional characteristics:

- closing the main shutter of the filler tube and establishing communication between the vessel and the discharge cannula when a residual volume of filler liquid is confined inside the cannula;
- simultaneously creating the vents for the container and for the cannula in particular in order to empty the residual volume of filler liquid located inside the cannula and in order to initiate filling; and
- controlling opening and closing of the shutter of the filler tube independently of the movements of inserting and removing the filler tube relative to the container.

The invention also proposes a machine for filling containers with the help of a filler liquid, the machine comprising:

- a vessel for storing a filler liquid that is maintained at a regulated pressure;
- at least one filler head, each filler head comprising a filler tube passing through a bearing seat for the container and provided with a main shutter for allowing or interrupting the passage of the filler liquid, the filler tube including internally a discharge cannula.

According to the invention:

- each filler tube together with the bearing seat defines externally a communication passage communicating with a circuit for a regulated vent from the container, the circuit having a shutter with controlled opening and closing;
- each discharge cannula is connected by controlled shutters either to a regulated vent circuit for the cannula, or to a communication circuit communicating with the vessel and enabling the container to be filled in gravity mode;
- each shutter of the filler tube is controlled by an actuator under the control of a control circuit; and
- the control circuit is connected to the various shutters and actuators so that:
  - during the initial filling stage, it opens the shutter of the filler tube, the controlled shutter of the vent circuit for the container, and the shutter of the vent circuit connected to the discharge cannula, and it closes the communication circuit between the vessel and the discharge cannula;

before the end of filling, it closes the controlled shutter of the vent circuit for the container, and the shutter of the vent circuit connected to the discharge cannula, and it opens the communication circuit with the vessel in order to fill the container in gravity mode; and at the end of filling, it controls the actuator to close the filler tube and to open the controlled shutter of the vent circuit for the container.

In addition, the machine of the invention may also present in combination at least one and/or another of the following additional characteristics:

the main shutter of the filler tube is mounted at the end of a cannula mounted inside the filler tube and is shaped so that, in the closed position, it cooperates in leaktight manner with the bottom end of the filler tube; and the main shutter of the filler tube is carried by the cannula to co-operate with a seat arranged inside the tube close to its top end.

Various other characteristics appear from the following description made with reference to the accompanying drawings, which show embodiments of the invention as non-limiting examples.

FIG. 1 is a diagrammatic view of the filler machine in accordance with the invention before engaging the container with the filler head.

FIG. 9 is a detail view of the discharge tube in the closed position.

Figure 2:
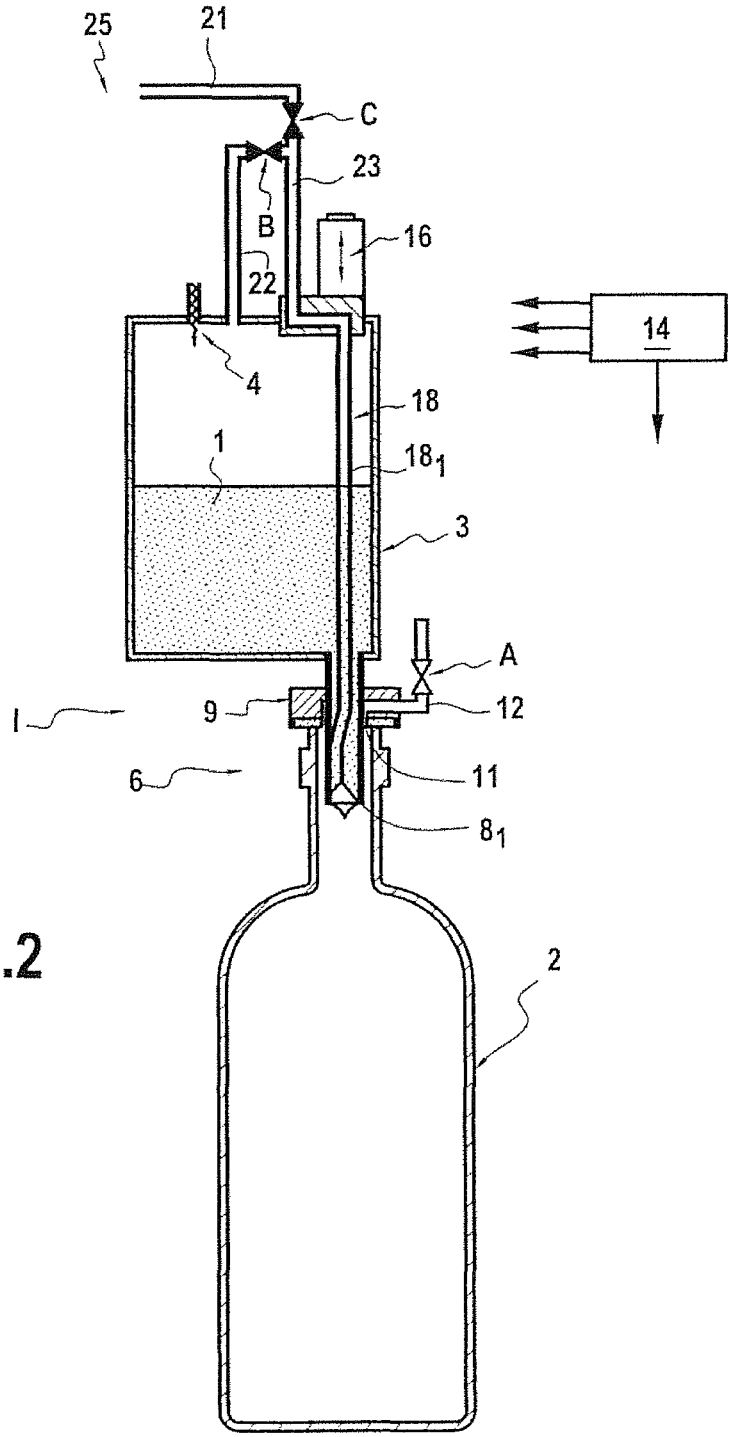
FIG. 2 is a view of the filler machine after engaging a container with the filler head, waiting for the container to be filled with liquid.

As can be seen more clearly in FIG. 1, the invention provides a machine I for using a liquid 1 to fill a container 2 up to a determined level. The container 2 may be of any kind, and for example it may be made of plastics material or of glass. Likewise, the liquid 1 may be of any kind, and for example it may be viscous, alcoholic, sweet, carbonated, flavored, colored, and with or without particles, etc.

The filler machine I has a storage vessel 3 for the liquid 1, which liquid is maintained at a regulated pressure by any appropriate means 4, such as a pressure regulator.

The filler machine I also has at least one filler head 6, and generally a plurality of filler heads 6, each adapted to fill a container 2 with the liquid 1. After being filled, each container 2 is removed and replaced by a new container for filling. The means for handling the containers 2 are not described in greater detail since they are well known to the person skilled in the art and do not specifically form part of the invention. Likewise, the filler machine I is not described in greater detail since it may take various shapes and configurations as a function in particular of the number of filler heads 6. The description below relates only to the operation of one filler head 6, however it is clear that the subject matter of the invention can apply to a machine having a series of filler heads, e.g. distributed in a line or at its periphery so as to provide a machine in the form of a carousel.

Each filler head 6 has a filler tube 8 communicating with the storage vessel 3. The filler tube 8 passes through a bearing seat 9 for bearing against the container 2, and in particular against the neck $\mathbf{2}_1$ of the container. The tube 8 thus projects from the bearing seat 9 so that its bottom end $\mathbf{8}_1$ extends below the bearing seat 9. Moving the container 2 upwards serves to insert the tube 8 via its bottom end $\mathbf{8}_1$ into the inside of the container 2 (FIG. 2). In the example shown, the filler tube 8 is a rigid tube that is directly connected to the vessel 3. Naturally, the filler tube 8 could be offset from the vessel 3, being connected thereto in rigid or flexible manner.

According to an advantageous characteristic of the invention, the bearing seat 9 and the filler tube 8 are movable vertically relative to each other in order to be able to adjust the height between the bottom end $\mathbf{8}_1$ of the tube and the seat 9. As explained in the description below, the bottom end $\mathbf{8}_1$ of the tube 8 defines the filling level for the liquid inside the container 2 such that adjusting the position of the bottom end $\mathbf{8}_1$ of the tube relative to the seat 9 serves to adjust the level to which the liquid is filled inside the container. The seat 9 is preferably mounted to be slidable in the vertical direction relative to the filler tube.

Together with the bearing seat 9, the filler tube 8 defines a passage 11 for communicating with a regulated vent circuit 12. This regulated vent circuit 12 for the container has a first controlled shutter such as a shutter A, e.g. a valve for opening or closing the regulated vent circuit 12. In the example shown, when the shutter A is in the open position, the container 2 communicates with a vent 13 for the container, which vent is an outlet to the surrounding air in the example shown. The shutter A is opened and closed under the control of a control circuit 14.

Advantageously, the bearing seat 9 includes a bearing gasket $\mathbf{9}_1$ for the neck $\mathbf{2}_1$ of the container so as to obtain sealing between the container 2 and the bearing seat 9. Thus, when in position bearing against the seat 9, the container 2 is capable of communicating solely with the regulated vent circuit 12 and the inside of the filler tube 8.

Figures 3, 10:
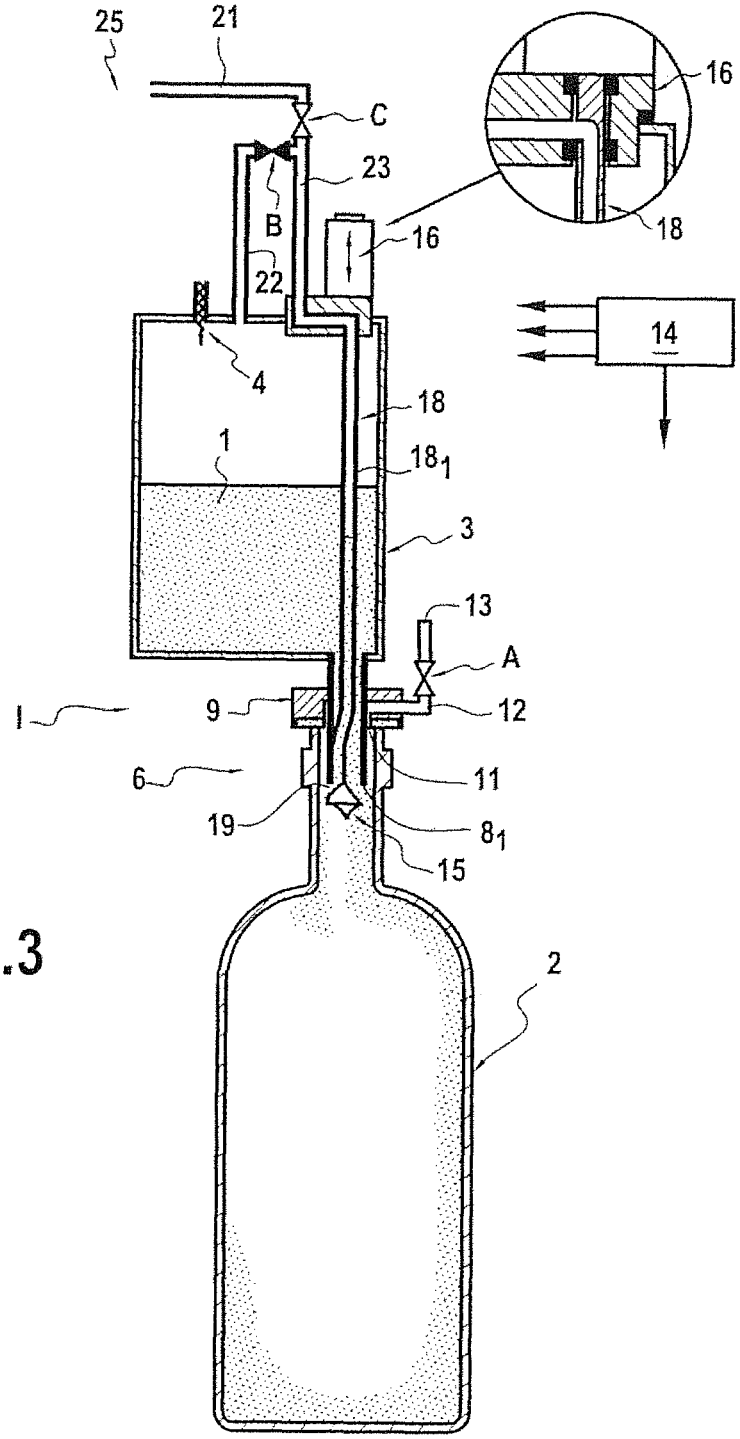
FIG. 3 shows the filler machine at the beginning of the stage of filling a container with a stream.
FIG. 10 is a detail view of the discharge tube in the open position.

The filler tube 8 has a main shutter 15 enabling the tube to be opened or closed in order to allow liquid to leave via the tube or in order to prevent liquid coming from the vessel 3 leaving. The main shutter 15 of the tube 8 is opened and closed under the control of an actuator 16, itself controlled by the control circuit 14. In the example shown, the main shutter 15 is moved in a vertical direction by the actuator 16 in order to occupy a shut position as shown by way of example in FIGS. 1 and 9, or an open position as shown in FIGS. 3 and 10, in which the liquid 1 coming from the vessel 3 can flow freely from the bottom end $\mathbf{8}_1$ of the tube 8.

In the embodiment shown in FIGS. 1 to 9, the main shutter 15 is mounted at the end of a tube or cannula 18 mounted inside the filler tube 8. In the example shown, the main shutter 15 is mounted at the end of the cannula and is shaped so that in the shut position it cooperates in leaktight manner with the bottom end $\mathbf{8}_1$ of the tube 8 (FIG. 1) forming the seat of the shutter.

In the shut position, the actuator 16 holds the cannula 18 in a high position (FIG. 9) in order to ensure contact between the main shutter 15 and the tube 8. The actuator 16 moving the cannula 18 downwards over a limited stroke, e.g. of a few millimeters (FIG. 10), enables the main shutter 15 to be separated from the tube 8, thereby allowing the liquid 1 to leave via the bottom end $\mathbf{8}_1$ of the tube 8 (FIG. 3). It should be observed that the main shutter 15 is arranged to present the shape of a deflector so as to guide the liquid inside the container 2. According to an advantageous characteristic of the invention, the cannula 18 constitutes a discharge cannula defining internally a flow circuit $\mathbf{18}_1$ for the liquid and for air in a manner that is described in the description below.

Figure 11:
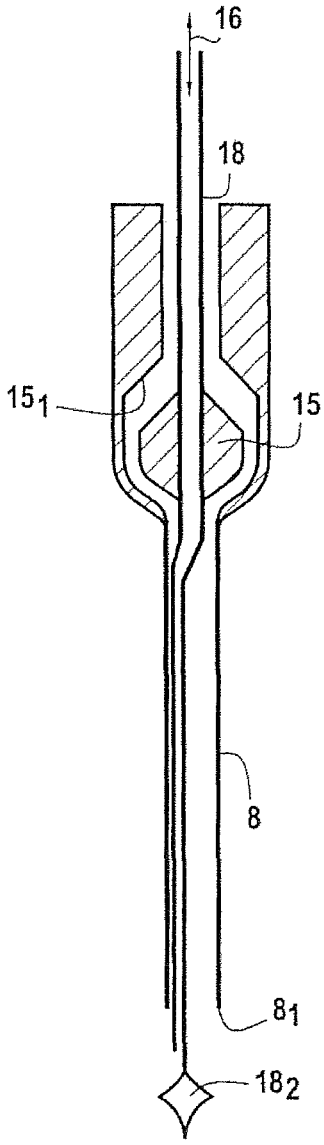
FIG. 11 is a diagrammatic view showing another variant embodiment for closing shutting of the filler tube of the filler machine of the invention.

Naturally, the flow of liquid leaving the tube 8 may be controlled in any appropriate manner. In the example shown in FIGS. 1 to 9, the main shutter 15 closes or opens the end $\mathbf{8}_1$ of the tube 8. FIG. 11 shows another embodiment in which the main shutter 15 is arranged inside the tube 8, close to its top end. In this example, the inside of the filler tube 8 is arranged to include a seat $\mathbf{15}_1$ against which the main shutter 15 as carried by the cannula 18 can co-operate. The end of the cannula 18 has a deflector $\mathbf{18}_2$ for the liquid leaving the filler tube 8.

In the examples described, the main shutter 15 moves vertically, however it is clear that the main shutter 15 could be moved in some other way, for example it could turn or pivot. Likewise, the actuator 16 may be of any known type adapted to the type of shutter. In the drawings, the actuator 16 acts directly on the end of the cannula 18 in order to move it vertically. Naturally, the actuator 16 could act on the cannula 18 without contacting it, and at any location suitable for moving it.

According to an advantageous characteristic of the invention, the discharge cannula 18 has a flow opening 19 at its bottom end opening out at the bottom end $\mathbf{8}_1$ of the filler tube 8.

According to a characteristic of the invention, the discharge cannula 18 is connected either to a regulated vent circuit 21, or to a circuit 22 in communication with the vessel 3. The communication circuit 22 and the regulated vent circuit 21 for the cannula 18 are connected to a common circuit 23 for connection with the flow circuit $\mathbf{18}_1$ defined by the cannula 18 and opening out via the flow opening 19.

The communication circuit 22 has a second shutter or shutter B such as a valve that is operated under the control of the control circuit 14. In the open position of the shutter B, the cannula 18 communicates with the vessel 3, enabling pressure to be in equilibrium between the pressure inside the container 2 and the pressure inside the vessel 3. As explained in greater detail in the description below, this communication enables the flow of liquid from the tube 8 to be slowed down in order to obtain filling in gravity mode.

The regulated vent circuit 21 for the cannula is fitted with a third shutter or shutter C such as a valve operated under the control of the control circuit 14. When the shutter C is open, the regulated vent circuit 21 for the cannula thus serves to put the discharge cannula 18 into communication with a vent 25 for the cannula, which vent in the example shown is to the surrounding air. It should be observed that the flow opening 19 of the cannula 18 is closed only if the shutters B and C are in the closed position.

By having programmed means, the control circuit 14 serves to control the actuator 16 and the various shutters A to C synchronously with the means for handling the containers 2.

In a position waiting to be filled, as shown in FIG. 1, the shutters A, B, and C are all in the closed position. The actuator 16 is also controlled so as to position the main shutter 15 in a position for closing the filler tube 8 (FIG. 9). Starting from this position, a container 2 can be brought so as to engage the bottom end of the tube 8 inside the container 2. The container is engaged so as to bear against the bearing seat 9 and provide sealing between the neck $\mathbf{2}_1$ and the bearing seat 9 (FIG. 2). In this position, it should be observed firstly that at least part of the cannula 18 contains liquid coming from a preceding filling operation, and secondly that the vessel 3 is regulated to a positive pressure by the regulator 4 that serves in particular to control the speed of filling.

In order to start filling of the container 2, the actuator 16 is controlled by the control circuit 14 so as to move the main shutter 15 and place it in the open position (FIGS. 3 and 10). Simultaneously, the shutters A and C are placed in the open position while the shutter B remains in the closed position. Opening the main shutter 15 allows the liquid to flow from the free end of the tube 8 into the inside of the container 2, which liquid comes from the inside of the vessel 3.

Opening the shutter C serves to put the flow circuit $\mathbf{18}_1$ of the cannula into communication with the vent 25 for the cannula. Opening the shutter A simultaneously with opening the shutter C serves to put the cannula 18 also into communication with the vent 13 for the container, thus facilitating emptying of the liquid present inside the cannula 18 and initiating the filling of the container 2. Furthermore, opening the shutter A serves to put the inside of the container 2 into communication via the passage 11 with the vent 13 for the container. The liquid 1 coming from the tube 8 and penetrating into the inside of the container 2 thus leads to the air contained in the container 2 being expelled. The air expelled by the liquid entering into the container 2 via the tube 8 is discharged via the vent 13 for the container and via the vent 25 for the cannula.

Figure 4:
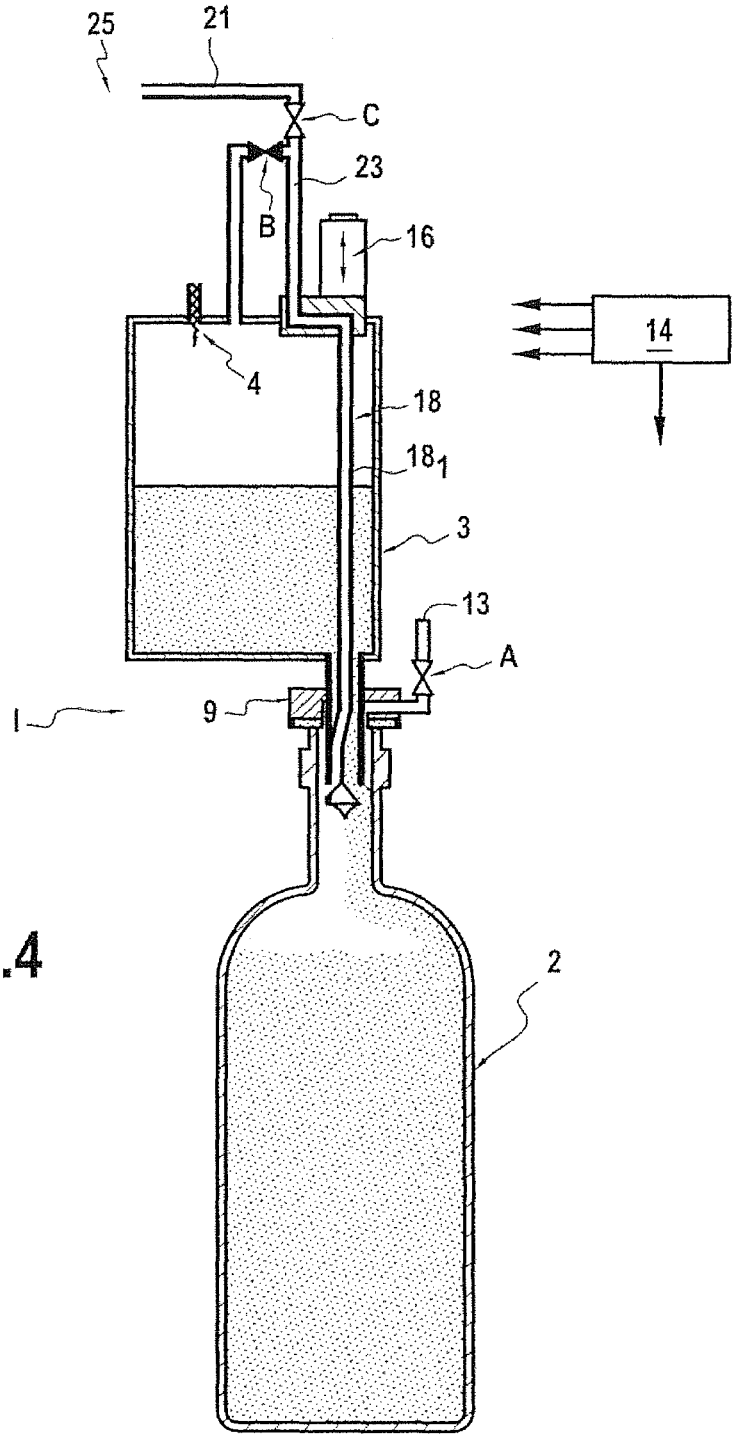
FIG. 4 shows the filler machine at the end of the stage of filling the container with a stream.

Opening the shutters A and C simultaneously encourages initiation of filling by emptying the cannula 18 filled with liquid from the preceding filling operation. The pressure difference between the pressurized vessel 3 and the container 2 ensures that the container is filled quickly in a "stream" filling mode (FIGS. 3 and 4). In this respect, it should be observed that the container 2 communicates with the surrounding air via two circuits (the regulated vent circuit 21 and the vent 25 for the cannula, and the regulated vent circuit 12 and the vent 13 for the container), thereby contributing to a faster flow of liquid into the inside of the container 2.

The fast filling in stream mode leads to large amounts of turbulence inside the container 2, in particular turbulence generated by the shape of the walls of the container. Thus, when the level of the liquid 1 comes up to the shoulder of the container 2, for example, bubbles and foam begin to form.

The method of the invention seeks to slow down the filling of the container 2 in stream mode so as to control the formation of this foam and these bubbles and so as to limit the volume of liquid that needs to be recirculated. This change in filling mode advantageously occurs when the level of the liquid reaches a zone in which the shape of the container 2 changes, such as the shoulder of a bottle (FIG. 4).

Thus, prior to the end filling, the method of the invention seeks to change from filling in stream mode to filling the container in gravity mode.

Figure 5:
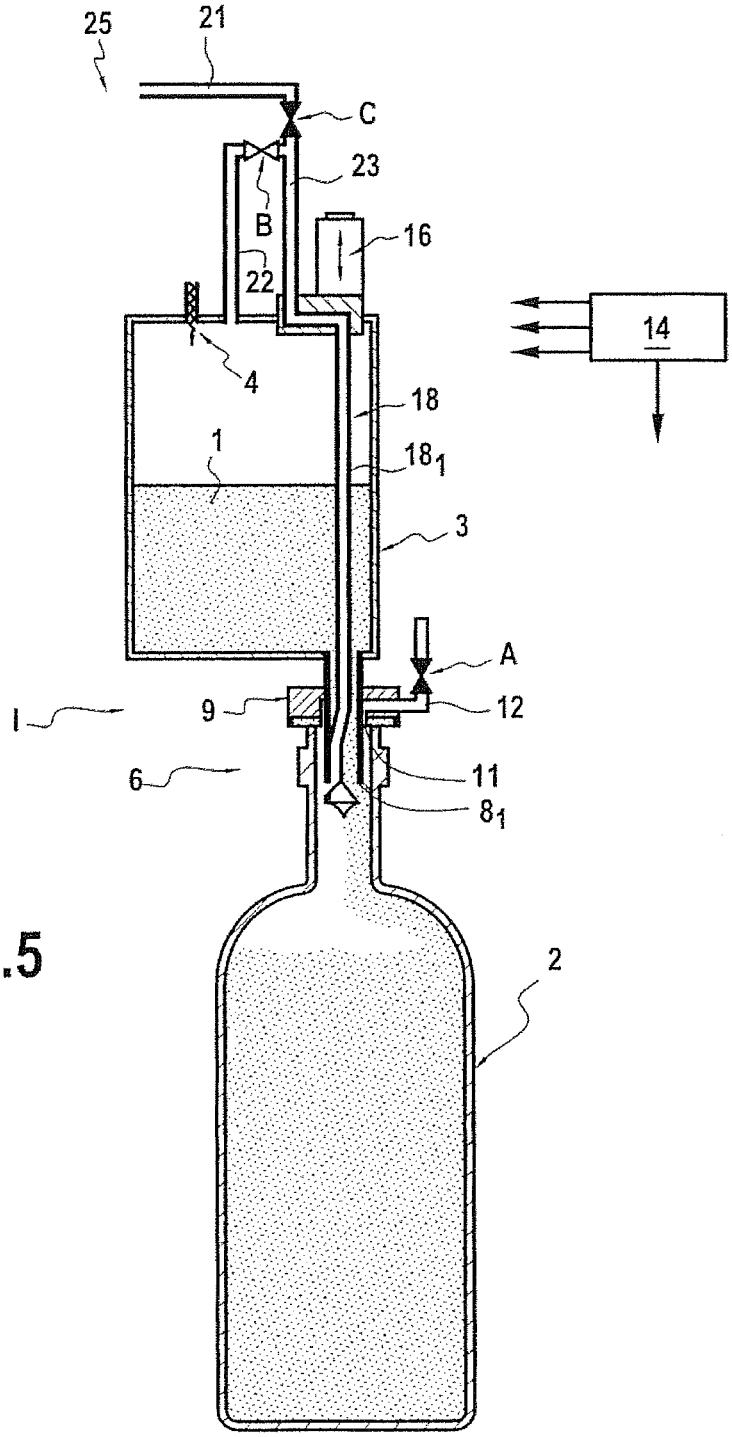
FIG. 5 shows the filler machine during a first end-of-filling stage referred to as "gravity mode".
Figure 6:
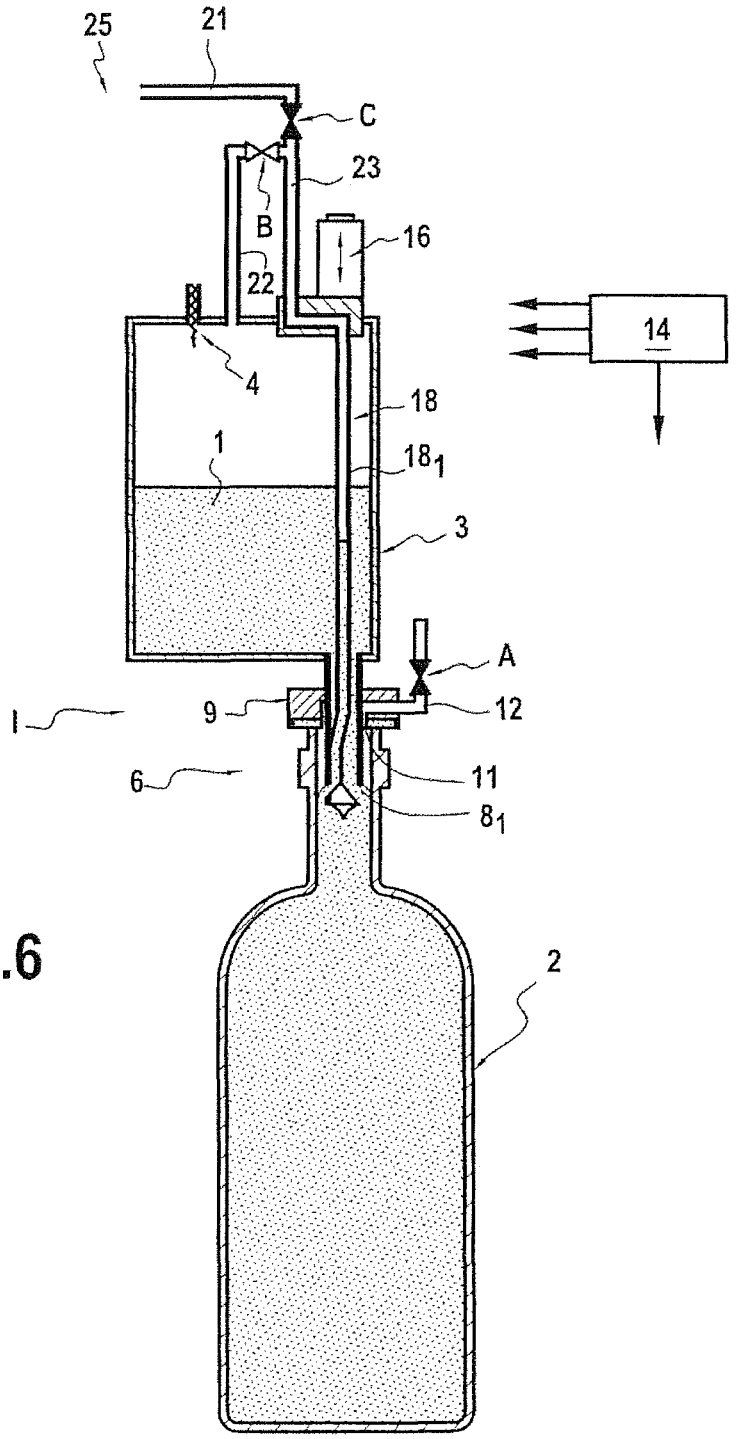
FIG. 6 shows the filler machine during a second end-of-filling stage said to be in "gravity mode".

Prior to the end of filling, the method of filling thus consists in closing the regulated vent circuit 12 for the container by closing the shutter A (FIG. 5). Simultaneously, the discharge cannula 18 is no longer connected to the regulated vent circuit 21 for the cannula (the shutter C is closed) but instead is put into communication with the vessel 3 via the communication circuit 22. For this purpose, the shutter B is placed in the open position. Insofar as the vessel 3 is under pressure, the pressure of air present in the container 2 comes into equilibrium with the pressure inside the vessel 3. Given the tendency for pressure to come into equilibrium between the vessel and the container, the liquid flows more slowly from the filler tube 8. This end-of-filling stage serves to go from the "stream" filling mode to a "gravity" filling mode. The effect of this change in filling mode is to reduce the formation of bubbles and thus of liquid foam, by slowing down the speed at which the liquid flows inside the container 2. This end-of-filling stage is continued until the container 2 is completely filled. In this respect, it should be observed that the liquid continues to leave the vessel via the tube 8 so as to become established at the level of the bottom end $\mathbf{8}_1$ of the tube 8. Naturally, the liquid in the container 2 cannot go below this level as determined by the bottom end of the tube 8 and is thus shifted into the cannula 18, but no further than the level of the liquid in the vessel 3.

Figure 7:
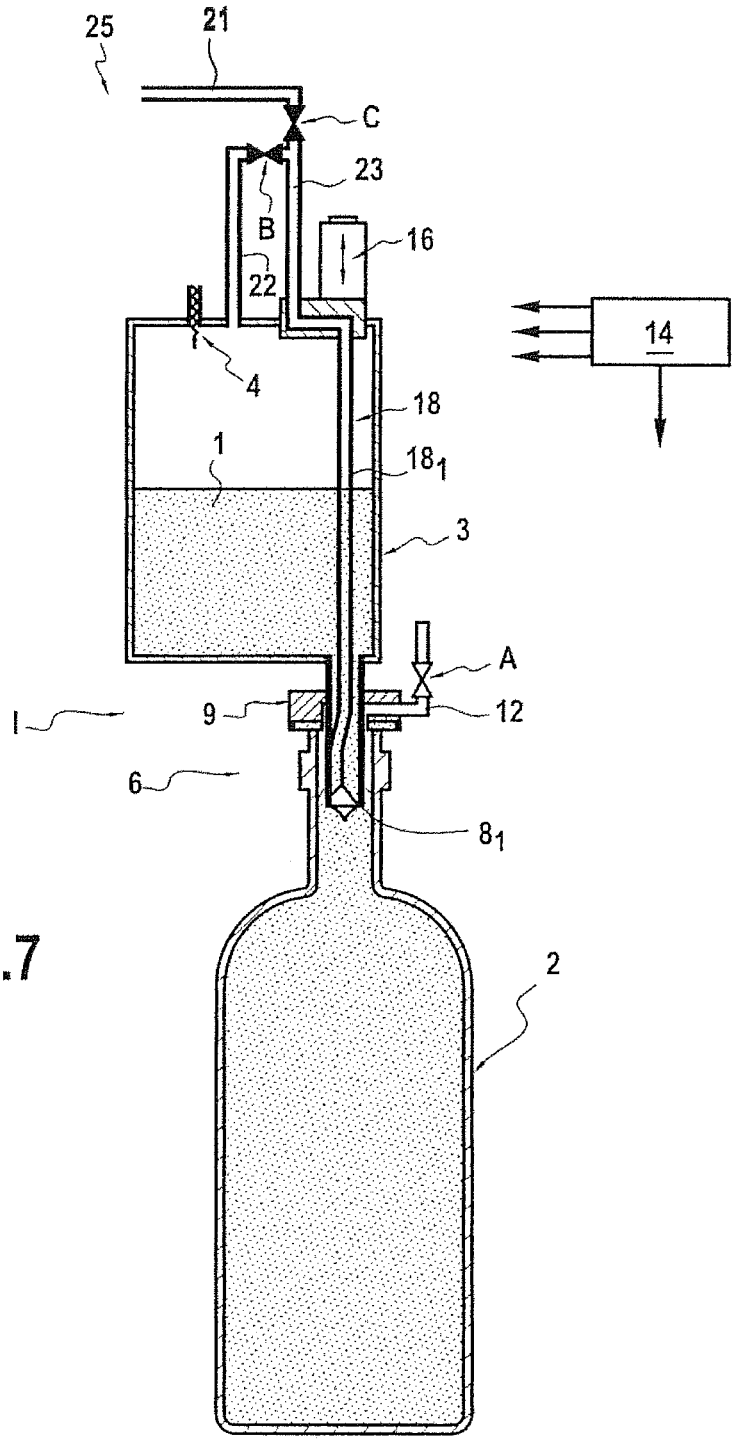
FIG. 7 is a view of the filler machine during a stage of stopping filling.

When the level of the liquid inside the container 2 reaches the bottom end of the tube 8 and at least a portion of the cannula 18 is full of liquid 1, at most up to the level of the liquid in the vessel 3, the filling operation is stopped. The filling operation is stopped by interrupting communication between the cannula 18 and the vessel 3 by controlling the actuator 16 so as to place the main shutter 15 in the closed position (FIGS. 7 and 9). In this position, the shutter 15 closes the filler tube 8 and the circuit is placed in position for closing the communication shutter 22. Advantageously, the shutter A of the vent circuit 12 for the container is placed in the open position so as to enable the pressure inside the container 2 to come into equilibrium with the outside, thus enabling the container 2 to be removed from the seat 9 without any suction phenomenon.

Figure 8:
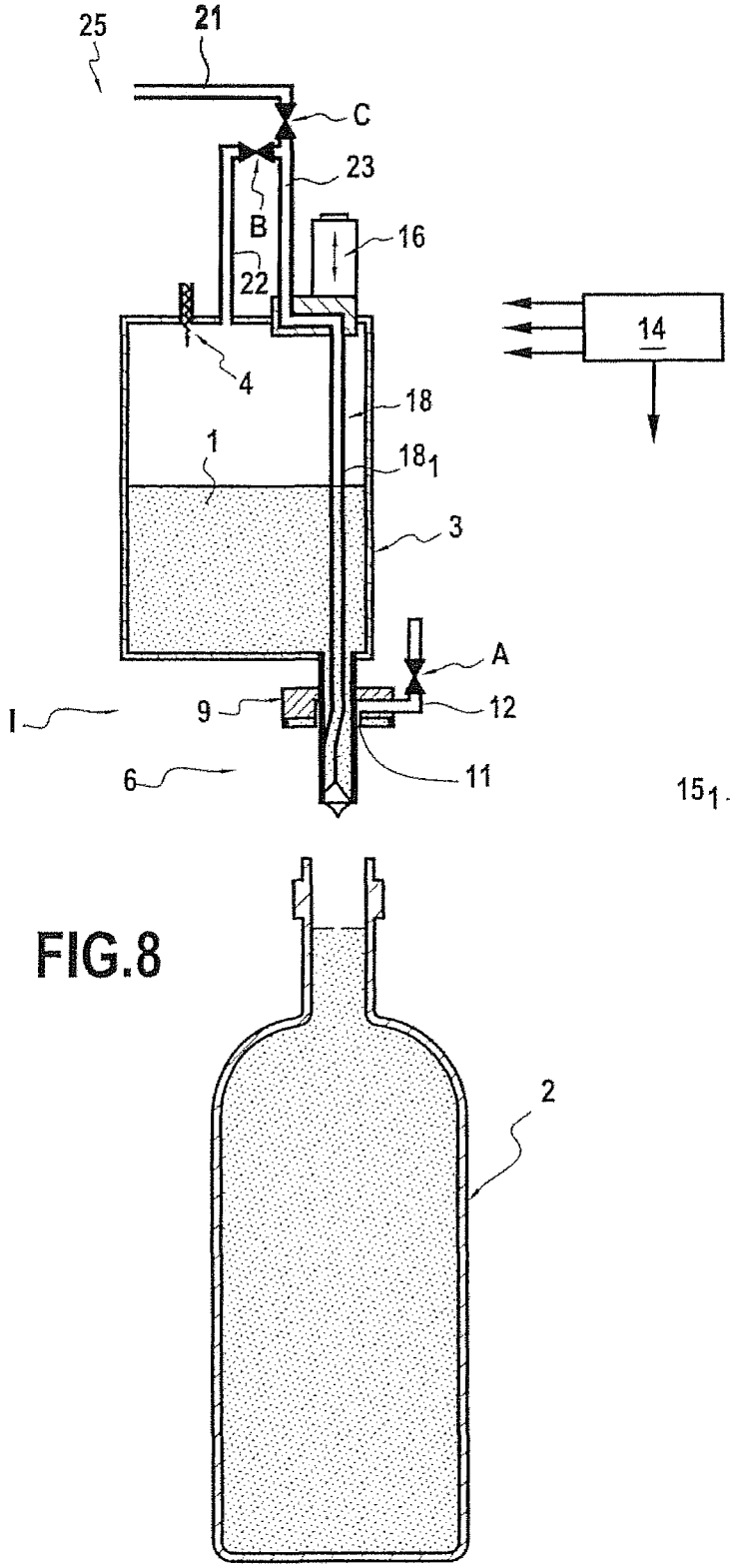
FIG. 8 shows the filler machine after removal of the filled container.

As can be seen more clearly in FIG. 8, the container 2 can then be removed from the bottom end of the filler duct 8. The shutter A goes to the closed position while the shutters B and C remain in the closed position. In this position, it should be observed that a portion of the cannula 18 contains liquid that will be delivered into a subsequent container, as explained above.

The invention thus makes it possible to fill a container up to a given level quickly and without using a vacuum or a vacuum pump. The filling level is determined by pressures coming into equilibrium when the liquid level reaches the filler tube.

The method of the invention offers the advantage of, being faster than prior art methods, in particular because of a fast initiation stage during which the cannula 18 is discharged in effective manner, thereby contributing to a fast flow of the liquid, communicating with the vents 13 and 25. Furthermore, filling in stream mode followed by gravity mode also makes it possible to save time during filling. In addition to an improvement in terms of filling speed, this technique limits the volume that needs to be recirculated, thereby reducing risks that might affect the quality of the liquid. Furthermore, the main shutter 15 of the filler tube is opened and closed independently of the movements of inserting and removing the container 2 relative to the filler tube, thus making it possible to use the control circuit 14 to control recirculation of the liquid.

The invention is not limited to the embodiments described and shown since various modifications can be made thereto without going beyond its ambit.

The invention claimed is:

1. A method of filling containers (2) with a filler liquid (1) stored in a pressure regulated vessel (3) and delivered via at least one filler head (6) comprising a filler tube (8) passing through a bearing seat (9) for the container (2) and provided with a main shutter (15) to allow or interrupt the passage of filler liquid, the filler tube (8) including internally a discharge cannula (18) connected by a second shutter (C) to a regulated vent circuit (21) having a vent (25) and connected to a circuit (22) in communication by a third shutter (B) with the vessel (3), the method being characterized in that it comprises the following steps for filling a container:

after engaging the filler tube (8) inside the container (2), closing by the third shutter (B), the circuit (22) in communication between the discharge cannula (18) and vessel (3), opening the main shutter (15) of the tube in order to fill the container (2) with the liquid in regulated stream mode, and creating both a fluid communication between the container and a vent (13) and fluid communication between the cannula (18) and the vent (13);

before the end of filling, closing the vents (13, 25) and putting the discharge cannula (18) into communication with the vessel (3) by opening the third shutter (B) in order to fill the container with the liquid in gravity mode; and at the end of filling, when the liquid reaches a determined level of the filler tube (8), closing the main shutter (15) of the filler tube (8), closing communication between the discharge cannula (18) and the vessel (3), and creating a vent (13) for the inside of the container so as to allow the container to be removed from the filler head (6).

2. A method of filling according to claim 1, characterized in that it consists in closing the main shutter (15) of the filler tube (8) and establishing communication between the vessel (3) and the discharge cannula (18) when a residual volume of filler liquid is confined inside the cannula (18).

3. A method of filling according to claim 1, characterized in that it consists in simultaneously creating the vents (13, 25) for the container and for the cannula in particular in order to empty the residual volume of filler liquid located inside the cannula (18) and in order to initiate filling.

4. A method of filling according to claim 1, characterized in that it consists in controlling opening and closing of the shutter (15) of the filler tube (8) independently of the movements of inserting and removing the filler tube relative to the container.

5. A filler machine for filling containers (2) with the help of a filler liquid (1), the machine comprising:

a vessel (3) for storing a filler liquid that is maintained at a regulated pressure;

at least one filler head (6), each filler head comprising a filler tube (8) passing through a bearing seat (9) for the container and provided with a main shutter (15) for allowing or interrupting the passage of the filler liquid, the filler tube including internally a discharge cannula (18), the machine being characterized in that:

each filler tube (8) comprising an external surface together with the bearing seat defines a communication passage (11) communicating with a circuit (12) for a regulated vent (13) from the container, the circuit having a shutter (A) with controlled opening and closing;

each discharge cannula (18) is connected by controlled shutter (C) to a regulated vent circuit (21) for the cannula and by a controlled shutter (B) to a communication circuit (22) communicating with the vessel (3) thereby enabling the container to be filled in gravity mode;

each shutter (15) of the filler tube is controlled by an actuator (16) under the control of a control circuit (14); and the control circuit (14) is connected to the various shutters and actuators so that:

during the initial filling stage, it opens the main shutter (15) of the filler tube (8), the controlled shutter (A) of the vent circuit (12) for the container, and the controlled shutter (C) of the vent circuit (21) connected to the discharge cannula (18), and it closes the communication circuit (22) between the vessel (3) and the discharge cannula (18);

before the end of filling, it closes the controlled shutter (A) of the vent circuit (12) for the container, and the controlled shutter (C) of the vent circuit (21) connected to the discharge cannula (18), and it opens the communication circuit (22) with the vessel (3) in order to fill the container in gravity mode; and at the end of filling, it controls the actuator (16) to close the filler tube (8) and to open the controlled shutter (A) of the vent circuit (12) for the container.

6. A filler machine according to claim 5, characterized in that the main shutter (15) of the filler tube (8) is mounted at the end of a cannula (18) mounted inside the filler tube (8) and is shaped so that, in the closed position, it cooperates in leaktight manner with a bottom end ($\mathbf{8}_1$) of the filler tube (8).

7. A filler machine according to claim 5, characterized in that the main shutter (15) of the filler tube (8) is carried by the cannula (18) to co-operate with a seat ($\mathbf{15}_1$) arranged inside the tube (8) close to its top end.

* * * * *